US008617779B2

(12) United States Patent
McGuire et al.

(10) Patent No.: US 8,617,779 B2
(45) Date of Patent: Dec. 31, 2013

(54) PHOTORECEPTOR SURFACE LAYER COMPRISING SECONDARY ELECTRON EMITTING MATERIAL

(75) Inventors: Gregory McGuire, Oakville (CA); Vladislav Skorokhod, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 336 days.

(21) Appl. No.: 12/900,383

(22) Filed: Oct. 7, 2010

(65) Prior Publication Data

US 2011/0086300 A1 Apr. 14, 2011

Related U.S. Application Data

(60) Provisional application No. 61/249,851, filed on Oct. 8, 2009.

(51) Int. Cl.
*G03G 5/147* (2006.01)

(52) U.S. Cl.
USPC ..... 430/66

(58) Field of Classification Search
USPC ..... 430/66
See application file for complete search history.

(56) References Cited

U.S. PATENT DOCUMENTS

| | | | | |
|---|---|---|---|---|
| 3,121,006 | A | 2/1964 | Middleton et al. | |
| 4,286,033 | A | 8/1981 | Neyhart et al. | |
| 4,291,110 | A | 9/1981 | Lee | |
| 4,338,387 | A | 7/1982 | Hewitt | |
| 4,387,980 | A | 6/1983 | Ueno et al. | |
| 4,464,450 | A | 8/1984 | Teuscher | |
| 4,515,882 | A * | 5/1985 | Mammino et al. | 430/58.45 |
| 4,587,189 | A | 5/1986 | Hor et al. | |
| 4,664,995 | A | 5/1987 | Horgan et al. | |
| 4,921,773 | A | 5/1990 | Melnyk et al. | |
| 5,215,839 | A | 6/1993 | Yu | |
| 5,660,961 | A | 8/1997 | Yu | |
| 5,756,245 | A | 5/1998 | Esteghamatian et al. | |
| 5,958,638 | A | 9/1999 | Katayama et al. | |
| 6,842,594 | B2 | 1/2005 | Frankel | |
| 2004/0126687 | A1 * | 7/2004 | Ikegami et al. | 430/58.75 |
| 2006/0142444 | A1 * | 6/2006 | Lee et al. | 524/205 |
| 2006/0160006 | A1 * | 7/2006 | Yamazaki et al. | 430/106.1 |
| 2006/0171870 | A1 * | 8/2006 | Qi et al. | 423/265 |

OTHER PUBLICATIONS

Diamond, "Handbook of Imaging Materials," p. 380-382, Marcel Dekker, NY, NY 1991.*

* cited by examiner

*Primary Examiner* — Peter Vajda
(74) *Attorney, Agent, or Firm* — Pillsbury Winthrop Shaw Pittman LLP

(57) ABSTRACT

Presently disclosed embodiments relate to an improved electrophotographic imaging member or photoreceptor comprising a surface layer on the photoreceptor, where the surface layer comprises secondary electron emitting materials that act as a robust electrically active layer. Photoreceptors incorporating such materials into or on the surface will exhibit an increase photoreceptor life and also a reduction the operating voltage of bias charge roll (BCR) charging systems while maintaining excellent charge uniformity.

14 Claims, 1 Drawing Sheet

PHOTORECEPTOR SURFACE LAYER COMPRISING SECONDARY ELECTRON EMITTING MATERIAL

RELATED APPLICATIONS

This non-provisional application claims priority to provisional U.S. Patent Application Ser. No. 61/249,851, filed on Oct. 8, 2009, which is expressly incorporated by reference.

BACKGROUND

The presently disclosed embodiments relate generally to layers that are useful in imaging apparatus members and components, for use in electrophotographic, including digital, apparatuses. More particularly, the embodiments pertain to an improved electrophotographic imaging member or photoreceptor comprising a surface layer on the photoreceptor, where the surface layer comprises secondary electron emitting materials that act as a robust electrically active layer that will serve to increase photoreceptor life and also reduce the operating voltage of bias charge roll (BCR) charging systems while maintaining excellent charge uniformity.

In electrophotographic or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing or ionographic printing and reproduction where charge is deposited on a charge retentive surface in response to electronically generated or stored images.

To charge the surface of a photoreceptor, a contact type charging device has been used. The contact type charging device includes a conductive member which is supplied a voltage from a power source with a D.C. voltage superimposed with a A.C. voltage of no less than twice the level of the D.C. voltage. The charging device contacts the image bearing member (photoreceptor) surface, which is a member to be charged. The contact type charging device electrostatically charges the image bearing member to a predetermined potential. Typically the contact type charger is in the form of a roll charger such as that disclosed in U.S. Pat. No. 4,387,980, the relative portions thereof incorporated herein by reference. U.S. Pat. No. 6,842,594 describes a contact type charger in the form of a bias charge roll member, the relative portions thereof also incorporated herein by reference.

Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule."

There is a significant need to extend photoreceptor life under bias charge roll (BCR) type charging systems. Photoreceptor surface damage is known to be caused by the flux of charged particles generated in the glow-discharge zone of the BCR. Current conventional photoreceptors used in BCR charging devices can achieve only several ten thousand prints before the photoreceptor is damaged and needs replacement. There is also a significant need to reduce power consumption and operating voltage in BCR charging systems while maintaining excellent charge uniformity. The charge current and threshold voltage are linked to the degradation of the photoreceptor surface and therefore the wear rate would be greatly improved through reduction of these parameters.

Thus, as the demand for improved print quality in xerographic reproduction is increasing, there is a continued need for achieving improved performance, such as finding a way to minimize or eliminate photoreceptor damage and wear, and to increase photoreceptor life.

SUMMARY

According to aspects illustrated herein, there is provided a photoreceptor comprising a surface layer of the photoreceptor further comprising a material having a high secondary electron emission coefficient ($\gamma$). In the present embodiments, the term "high secondary electron emission coefficient" is defined as a coefficient value indicating that the material has a sufficient enough emission of secondary electrons from the material upon ion bombardment from the glow discharge generated between the photoreceptor surface and the biased charger roller (BCR) to facilitate a reduction in BCR operating AC voltage of from about 10% to about 90% when compared to a photoreceptor surface without the secondary electron emitting material. More specifically, the material has a sufficient enough emission of secondary electrons from the material upon ion bombardment from the glow discharge generated between the photoreceptor surface and the biased charger roller (BCR) to facilitate a reduction in BCR operating AC voltage of from about 20% to about 80% when compared to a photoreceptor surface without said secondary electron emitting material, and even more specifically, to facilitate a reduction in BCR operating AC voltage of from about 40% to about 60% when compared to a photoreceptor surface without said secondary electron emitting material.

The surface layer of the present embodiments may be presented in numerous configurations so long as the layer comprises a surface portion of the photoreceptor. For example, in embodiments, the surface layer may be a charge transport layer or be a separate layer disposed on top of the charge transport layer. In other embodiments, where the photoreceptor comprises an overcoat layer, the surface layer may be the overcoat layer or be a separate layer disposed on top of the overcoat layer. In these embodiments, the high secondary electron emitting material can be, in certain embodiments, contained in both the charge transport or overcoat layer as well as the surface layer disposed on top of the charge transport layer or overcoat layer. In further embodiments, where the photoreceptor comprises a single layer disposed on the substrate, the surface layer may be that single layer or be a separate layer disposed on top of the single layer. In these embodiments, the high secondary electron emitting material can be, in certain embodiments, contained in both the single photoreceptor layer as well as the surface layer disposed on top of the single photoreceptor layer.

In another embodiment, there is provided a photoreceptor comprising a substrate; a charge generation layer disposed on the substrate; a charge transport layer disposed on the charge generation layer; an overcoat layer disposed on the charge transport layer; and a surface layer disposed on the overcoat layer, wherein both the charge transport layer and the overcoat layer comprise a material having a secondary electron emission coefficient (γ) higher than that of the surface layer and having a high sputter resistance.

Yet another embodiment, there is provided an image forming apparatus for forming images on a recording medium comprising (a) a photoreceptor having a charge retentive-surface for receiving an electrostatic latent image thereon, wherein the photoreceptor comprises a substrate, an optional undercoat layer disposed on the substrate, a charge generation layer disposed on the undercoat layer, a charge transport layer disposed on the charge generation layer, and a surface layer disposed on the charge transport layer, wherein the surface layer of the photoreceptor comprises a material having a high secondary electron emission coefficient (γ) and having a high sputter resistance; (b) a development component for applying a developer material to the charge-retentive surface to develop the electrostatic latent image to form a developed image on the charge-retentive surface; (c) a transfer component for transferring the developed image from the charge-retentive surface to a copy substrate; and (d) a fusing component for fusing the developed image to the copy substrate.

BRIEF DESCRIPTION OF THE DRAWINGS

For a better understanding, reference may be made to the accompanying figures.

DETAILED DESCRIPTION

Figure 1:
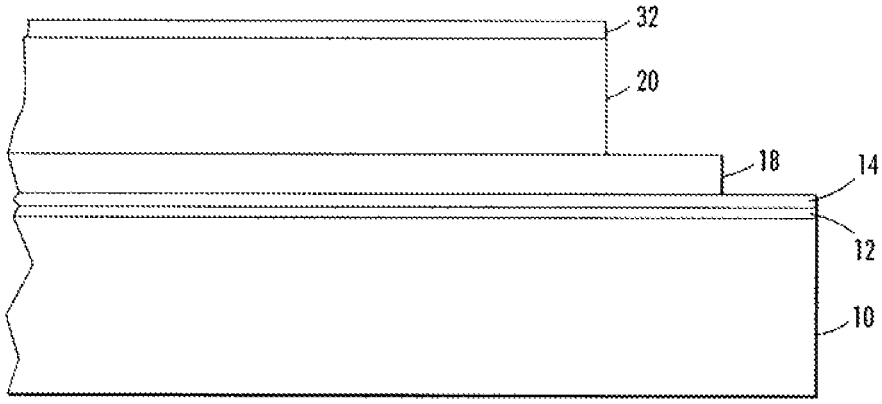
FIG. 1 is a schematic view of a photoreceptor in a drum configuration according to the present embodiments.

In the following description, reference is made to the accompanying drawings, which form a part hereof and which illustrate several embodiments. It is understood that other embodiments may be used and structural and operational changes may be made without departure from the scope of the present disclosure.

In the xerographic process, a latent image of charge is created on a dielectric. Certain systems of charge deposition such as bias charge roll (BCR), create charge species through glow discharge of a gas very close to the dielectric surface. The charge species causes degradation in the dielectric, and thus, the dielectric used in the xerographic devices degrade quickly by the glow discharge mechanism. Thus, the life of the photoreceptor is reduced significantly.

The presently disclosed embodiments are directed to an improved electrophotographic imaging member or photoreceptor comprising a surface layer on the photoreceptor, where the surface layer comprises secondary electron emitting materials that act as a robust electrically active layer that will serve to increase photoreceptor life and is advantageous to the operation of the photoreceptor in bias charge roll (BCR) charging systems. These secondary electron emitting materials (exo-electron) have a high secondary electron yield coefficient gamma (γ).

The secondary electron emission coefficient γ is defined as the number of electrons ejected per incident ion. To be electrically effective, the present embodiments use secondary electron emitting materials that have a strong secondary electron emission coefficient and have a relatively low sputter yield. For example, the present embodiments use materials having a secondary electron emission coefficient that is higher than the surface of the photoreceptor without said materials. Generally, the secondary electron emission is strongly determined by the surface preparation rather than the intrinsic material. However, the present embodiments provide a combination of a robust material against glow discharge as well as strong secondary electron emission. The present embodiments also provide photoreceptors having surface layers that have high sputter resistance, and thus comprise one or more materials that have high heat of sublimate as well as being good emitters of secondary electrons. In conventional BCR type charging systems, a photoreceptor surface without the inventive material will have a relatively low secondary electron coefficient and a photoreceptor surface with the inventive material will have a relatively high secondary electron coefficient.

When added into or on top of the photoreceptor surface, the secondary electron emitting materials form a robust electrically active layer that will serve to significantly increase photoreceptor life while at the same time reducing the operating voltage of the BCR charging system while maintaining excellent charge uniformity. In embodiments, the secondary electron emitting material comprises magnesium oxide (MgO), for example, a high gamma form of MgO. This material can be used to form the robust electrically active layer The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems. Likewise, while the discussion describes the present embodiments in terms of imaging members in a drum configuration, the present embodiments may also be used in those having belt configurations.

FIG. 1 is an exemplary embodiment of a multilayered electrophotographic imaging member having a drum configuration. As can be seen, the exemplary imaging member includes a rigid support substrate 10, an electrically conductive ground plane 12, an undercoat layer 14, a charge generation layer 18 and a charge transport layer 20. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer.

As discussed above, an electrophotographic imaging member generally comprises at least a substrate layer, an imaging layer disposed on the substrate and an optional overcoat layer disposed on the imaging layer. In further embodiments, the imaging layer comprises a charge generation layer disposed on the substrate and the charge transport layer disposed on the charge generation layer. In other embodiments, an undercoat layer may be included and is generally located between the substrate and the imaging layer, although additional layers may be present and located between these layers. The imaging member may also include anticurl back coating layer in certain embodiments. The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing charged particles of same or opposite polarity on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Figure 2:
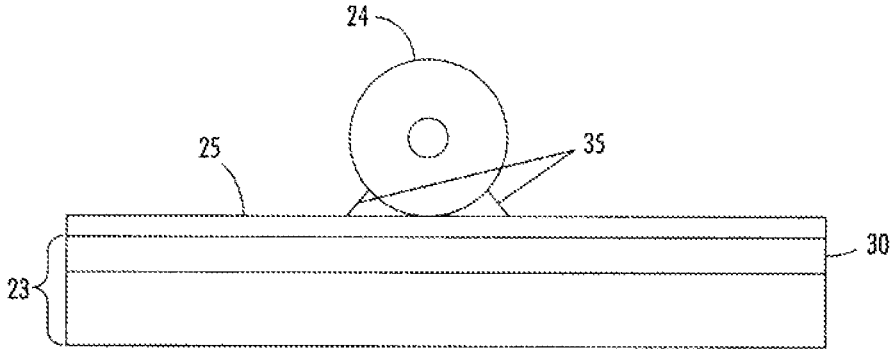
FIG. 2 is a partial schematic view of a photoreceptor surface comprising high γ material to assist glow discharge at low voltages and protect the dielectric layer (CTL layer) from degradation according to the present embodiments.

In FIG. 2, a diagram is provided to show a photoreceptor surface 23 comprising secondary electron emitting material to assist glow discharge at low voltages and protect the dielectric layer (CTL layer) from degradation. As discussed above, charging of the photoreceptor involves contact charging of the photoreceptor by a bias charge roll (BCR) 24 to charge the photoconductive surface of the photoreceptor to a relatively high, substantially uniform potential. However, there is a significant limitation placed on photoreceptor life through conventional BCR charging from degrading charged particles. As can be seen from FIG. 2, in the present embodiments, the protective surface layer 25 comprising high γ secondary electron emitting material, such as MgO, absorbs the ion collisions produced by the discharge gas upon discharge during charging of the photoreceptor, thereby protecting the dielectric layer 30 from the ion collisions and decreasing the discharge voltage by emitting secondary electrons 35. As a result, photoreceptor degradation is substantially reduced. The protective surface layer 25 is generally formed on the dielectric layer 30 and generally ranges in thickness from about 2,000 Å to about 5,000 Å. The protective surface layer may be formed by sputtering, electron beam deposition, ion beam assisted deposition (IBAD), chemical vapor deposition (CVD), sol-gel techniques, and the like. Other high γ secondary electron emitting materials that may be used include high γ form of carbon, silicon, silicon oxide, calcium oxide, germanium, germanium oxide, zinc, zinc oxide, tin oxide, and the like, and mixtures thereof.

In particular embodiments, the protective surface layer comprises high γ MgO. Specific high γ thin film materials such as the high γ form of magnesium oxide have good physical properties. For example, the materials have high sputter resistance and thus provide an excellent protection layer for dielectrics in proximity to glow discharge. A protective surface layer comprising these materials is also mechanically robust, and exhibits excellent adhesion to dielectric surfaces. In terms of electrical properties, the protective surface layer comprising high γ MgO of the present embodiments provide strong secondary electron emission. Such embodiments further assist glow discharge, for example, lower operating voltage and increase discharge probability, and provides good resistivity, through the dielectric material itself. Furthermore, thin films comprising the high γ MgO can be used to make surface layers that are highly transparent.

As discussed, the BCR charging system is considered the primary source of photoreceptor surface wear due to the glow discharge mechanism breaking down the surface of the photoreceptor which is then swept away by the cleaning blade. Thus, the present embodiments will provide a coating of a dense thin film of selected secondary electron emitting materials on the surface of a photoreceptor which will facilitate an exceptionally strong resistance to surface degradation from the BCR glow discharge system while also substantially reducing the operating voltage required to charge the photoreceptor surface uniformly. Secondary electron emitting characteristics can be measured using a faraday cup and full device BCR testing can be completed using a BCR wear fixture.

In embodiments, the high γ form material may be used to incorporate into the surface of a photoreceptor (with or without an overcoat layer) in various forms, for example, crystal, thin film or polycrystalline powder. The layer of the material may be fabricated on or into the photoreceptor surface via one or more of the following methods: e-beam deposition, ion beam assisted deposition (IBAD), sputtering, sol-gel coating, and chemical vapor deposition. In a specific method, the high γ form material is obtained in powder form and dispersed into the overcoat or charge transport solution to be used to form the overcoat layer or charge transport layer.

In further embodiments, the secondary electron emitting material is coated as a thin layer on top of the charge transport layer or the overcoat layer. In such embodiments, the protective layer has a thickness of from about 100 Å to about 20,000 Å. In more specific embodiments, the protective layer has a thickness of from about 1,000 Å to about 9,000 Å, or from about 1,000 Å to about 2,000 Å, or from about 2,000 Å to about 5,000 Å.

In other embodiments, the high γ form material is fabricated externally as a powder and subsequently dispersed into an overcoat or charge transport solution for forming the overcoat layer or charge transport layer of the photoreceptor. In such embodiments, the high γ form material is present in the overcoat layer or the charge transport layer in an amount of from about 0.1 percent to about 10 percent, or from about 1 percent to about 5 percent by weight of the total weight of the respective layer.

In yet other embodiments, the high γ form material is obtained externally as a powder and then sprayed onto a semi-cured overcoat layer or charge transport layer of the photoreceptor. In such embodiments, the high γ form material is sprayed to form a layer having a thickness range similar to that identified above.

The other layers present in conventional photoreceptors are generally described below with reference to the drawings. Again, the specific terms are used in the following description for clarity, selected for illustration in the drawings and not to define or limit the scope of the disclosure. The same reference numerals are used to identify the same structure in different figures unless specified otherwise.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous"

layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

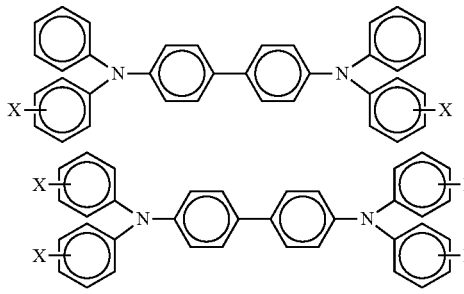

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

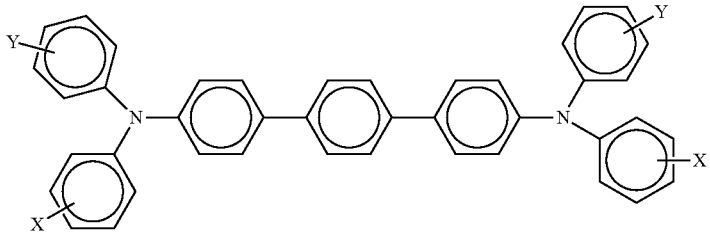

and

-continued

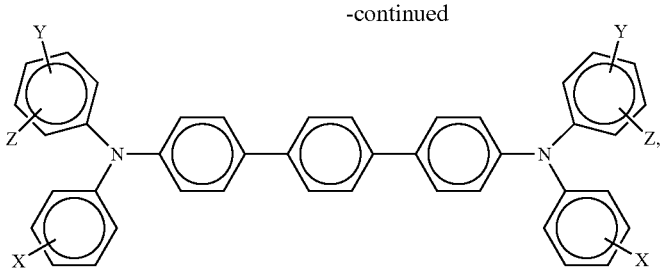

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Comparative Example 1

A comparative photoconductor is prepared as follows. A three component hole blocking or undercoat layer is prepared as follows. Zirconium acetylacetonate tributoxide (35.5 parts), γ-aminopropyl triethoxysilane (4.8 parts), and poly (vinyl butyral) BM-S (2.5 parts) are dissolved in n-butanol (52.2 parts). The resulting solution is coated via a dip coater on an 85 millimeter aluminum tube, and the resulting layer is pre-heated at 59° C. for 13 minutes, humidified at 58° C. (dew point of 54° C.) for 17 minutes, and dried at 135° C. for 8 minutes. The thickness of the undercoat layer obtained is approximately 1.3 microns.

A photogenerating layer of a thickness of about 0.2 micron comprising hydroxygallium phthalocyanine Type V is deposited on the above hole blocking layer or undercoat layer with a thickness of about 1.3 microns. The photogenerating layer coating dispersion is prepared as follows. 3 Grams of hydroxygallium Type V pigment are mixed with 2 grams of a polymeric binder of a carboxyl-modified vinyl copolymer, VMCH, available from Dow Chemical Company, and 45 grams of n-butyl acetate. The resulting mixture is milled in an Attritor mill with about 200 grams of 1 millimeter Hi-Bea borosilicate glass beads for about 3 hours. The obtained dispersion is filtered through a 20 micron Nylon cloth filter, and the solid content of the dispersion is diluted to about 6 weight percent.

A 24 micron thick charge transport layer is coated on top of the photogenerating layer from a solution that is prepared from N,N'-diphenyl-N,N-bis(3-methylphenyl)-1,1'-biphenyl-4,4'-diamine (5 grams), a film forming polymer binder PCZ 400 [poly(4,4'-dihydroxy-diphenyl-1-1-cyclohexane, $M_w$ of 40,000)] available from Mitsubishi Gas Chemical Company, Ltd. (7.5 grams) in a solvent mixture of 30 grams of tetrahydrofuran (THF), and 10 grams of monochlorobenzene (MCB) via simple mixing. The charge transport layer is dried at about 135° C. for about 40 minutes.

Example 1

A photoconductor is prepared by repeating the process of the Comparative Example except that a 1200 angstrom layer of Magnesium Oxide is formed on top of the Charge transport layer using e-beam reactive evaporation of Magnesium metal in the presence of oxygen.

Example 2

A photoconductor is prepared by repeating the process of the Comparative Example except that a 1200 angstrom layer of Magnesium Oxide is formed on top of the Charge transport layer using e-beam evaporation of Magnesium Oxide pellets.

Comparative Example 2

A photoconductor is prepared by repeating the process of the Comparative Example 1 except that the photoreceptor is prepared on a 30 millimeter tube. This example was fabricated for a wear test.

Example 3

A photoconductor is prepared by repeating the process of the Comparative Example 1 except that the photoreceptor is prepared on a 30 millimeter tube and 2000 angstrom layer of Magnesium Oxide is formed on top of the Charge transport layer using e-beam reactive evaporation of Magnesium metal in the presence of oxygen. This example was also fabricated for a wear test.

Testing

The devices prepared in Comparative Example 1 and Examples 1 through 2 were tested in terms of photodischarge characteristics, operating voltage, and surface wear.

Photodischarge characteristics were evaluated by measuring the surface potential of the photoconductor at specified time intervals before and after various photo exposure energies. Discharge rate was determined by electrostatically charging the surfaces of the imaging members with a dielectric gap charger roll, in the dark until the surface potential attained an initial value of about 500 V, as measured by an electrostatic voltmeter (ESV) probe attached to an electrometer. The devices were then exposed to light energy for 11 ms having a wavelength of 780 nm from a filtered xenon lamp. A reduction in the surface potential due to photo discharge effect ($V_{low}$) was measured at 117 milliseconds after photo discharge for various exposure light energies. The exposure light energy ranged from about 10 ergs per centimeter squared to zero ergs per centimeter squared. The light exposure energy gives a photo induced discharge curve (PIDC). $V_{low}$ measurements at 6 ergs per centimeter squared light exposure energy are used for comparison of Examples 1 through 3.

For the imaging member in the Comparative Example 1, the voltage 117 ms after light exposure of 6 ergs/cm$^2$ was 54 V. This data indicates a relatively standard discharge rate found in most conventional photoreceptors.

For the imaging member in Example 1, the voltage 117 ms after light exposure of 6 ergs/cm$^2$ was 62 V. This data indicates a relatively small decrease in discharge rate when compared to the comparative example.

For the imaging member in Example 2, the voltage 117 ms after light exposure of 6 ergs/cm$^2$ was 60 V. This data indicates a relatively small decrease in discharge rate when compared to the comparative example.

Operating voltage was evaluated by using a biased charging roller to charge the surface of the example photoreceptor devices. The AC voltage of the biased charging roller is set to the minimum AC voltage sufficient enough to charge the surface of the example photoreceptors to 500 V.

For the imaging member in the Comparative Example 1, the minimum AC voltage required to achieve 500 V surface charge was 1300 V. This data indicates a relatively high AC voltage is required.

For the imaging member in Example 1, the minimum AC voltage required to achieve 500 V surface charge was 630 V. This data indicates a relatively low AC voltage is required.

For the imaging member in Example 2, the minimum AC voltage required to achieve 500 V surface charge was 700 V. This data indicates a relatively low AC voltage is required.

Photoreceptor surface wear was evaluated using a Xerox F469 CRU drum/toner cartridge. The surface wear is determined by the change in thickness of the photoreceptor after 50,000 cycles in the F469 CRU with cleaning blade and single component toner. The thickness was measured using a Permascope ECT-100 at one inch intervals from the top edge of the coating along its length. All of the recorded thickness values were averaged to obtain and average thickness of the entire photoreceptor device. The change in thickness after 50,000 cycles was measured in nanometers and then divided by the number of kcycles to obtain the wear rate in nanometers per kcycle.

For the imaging member in the Comparative Example 2, wear rate was measured to be 88.4 nm/kcycle. This data indicates a relatively high wear rate.

For the imaging member in the Example 3, wear rate was measured to be 1.6 nm/kcycle. This data indicates a relatively low wear rate.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A photoreceptor comprising:

a charge transport layer;

a surface layer disposed on the charge transport layer; wherein the surface layer comprises a secondary emitting material having a high secondary electron emission coefficient (γ); wherein the secondary emitting material comprises a high γ form of magnesium oxide; wherein the photoreceptor surface layer comprising the secondary electron emitting material has a thickness of from about 1,000 Å to about 2,000 Å.

2. The photoreceptor of claim 1, wherein the surface layer is a charge transport layer.

3. The photoreceptor of claim 1, wherein the surface layer is an overcoat layer.

4. The photoreceptor of claim 1, wherein the surface layer is a protective surface layer and the photoreceptor further comprises an overcoat layer disposed between the charge transport layer and the surface protective surface layer.

5. The photoreceptor of claim 1, wherein the surface layer is formed on the photoreceptor by a method selected from the group consisting of e-beam deposition, sputtering, sol-gel coating, chemical vapor deposition, ion-beam assisted deposition (IBAD), dispersion into a photoreceptor layer solution, and mixtures thereof.

6. The photoreceptor of claim 1, wherein the surface layer is formed from spraying the secondary electron emitting material in powder form onto a semi-cured overcoat layer or a semi-cured charge transport layer.

7. The photoreceptor of claim 1, wherein the secondary electron emitting material is obtained in a form of crystal, thin film or polycrystalline powder.

8. The photoreceptor of claim 1, wherein the surface layer comprising the secondary electron emitting material is formed from dispersing the secondary electron emitting material in powder form into a photoreceptor layer solution.

9. The photoreceptor of claim 1, wherein the secondary electron emitting material is present in an amount of from about 1 percent to about 5 percent by weight of the total weight of the surface of the photoreceptor.

10. A photoreceptor comprising a substrate;

a charge generation layer disposed on the substrate;

a charge transport layer disposed on the charge generation layer;

an overcoat layer disposed on the charge transport layer; and a surface layer disposed on the overcoat layer, wherein the surface layer comprises a secondary electron emitting material and having a thickness of from about 2,000 Å to about 5,000 Å;

wherein both the charge transport layer and the overcoat layer comprise a secondary emitting material having a secondary electron emission coefficient (γ) higher than that of the surface layer and having a high sputter resistance; wherein the secondary emitting material comprises a high γ form of magnesium oxide.

11. The photoreceptor of claim 10, wherein the photoreceptor surface layer is formed on the photoreceptor by a method selected from the group consisting of e-beam deposition, sputtering, sol-gel coating, chemical vapor deposition, ion-beam assisted deposition (IBAD), dispersion into a photoreceptor layer solution, and mixtures thereof.

12. The photoreceptor of claim 10, wherein the secondary electron emitting material is obtained in a form of crystal, thin film or polycrystalline powder.

13. An image forming apparatus for forming images on a recording medium comprising:

a) a photoreceptor having a charge retentive-surface for receiving an electrostatic latent image thereon, wherein the photoreceptor comprises a substrate;

an optional undercoat layer disposed on the substrate;

a charge generation layer disposed on the undercoat layer;

a charge transport layer disposed on the charge generation layer; and a surface layer disposed on the charge transport layer, wherein the surface layer of the photoreceptor comprises a secondary emitting material having a high secondary electron emission coefficient (γ) and having a high sputter resistance;

wherein the secondary emitting material comprises a high γ form of magnesium oxide; wherein the photoreceptor surface layer has a thickness of from about 1,000 Å to about 2,000 Å;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

14. The image forming apparatus of claim 13, wherein the surface layer is an overcoat layer and further wherein the secondary electron emitting material is incorporated into both the charge transport layer and the overcoat layer.

* * * * *